US006470820B1

(12) United States Patent
Wilkins

(10) Patent No.: US 6,470,820 B1
(45) Date of Patent: Oct. 29, 2002

(54) INTERLOCKING SYSTEM, APPARATUS AND METHOD FOR CONNECTING MODULES

(75) Inventor: Daniel Latimer Wilkins, St. Leonard, MD (US)

(73) Assignee: CDI Corporation, Severna Park, MD (US)

( * ) Notice: Subject to any disclaimer, the term of this patent is extended or adjusted under 35 U.S.C. 154(b) by 4 days.

(21) Appl. No.: 09/620,565

(22) Filed: Jul. 20, 2000

Related U.S. Application Data

(60) Provisional application No. 60/178,715, filed on Jan. 28, 2000.

(51) Int. Cl.[7] ..... B63B 35/44
(52) U.S. Cl. ..... 114/266
(58) Field of Search ..... 114/263, 266, 114/267, 264, 248, 249, 252

(56) References Cited

U.S. PATENT DOCUMENTS 3,057,315 A * 10/1962 Robishaw ..... 114/266
3,073,271 A 1/1963 Brill ..... 114/0.5
3,691,974 A * 9/1972 Seiford, Sr. et al. ..... 114/266
4,115,020 A 9/1978 Langsford ..... 403/322
4,487,151 A * 12/1984 Deiana ..... 114/266
4,928,616 A * 5/1990 Robishaw et al. ..... 114/267
5,697,313 A * 12/1997 Horn et al. ..... 114/77 R
5,988,932 A 11/1999 Haney et al. ..... 403/321

FOREIGN PATENT DOCUMENTS

GB 804 207 11/1958

OTHER PUBLICATIONS

Government Furnished Information for the Study of Ocean Barge Module Connection System Development (Jan. 1994).
FBM Marine Limited, Mexecell Modular Logistics System.
Robishaw Engineering, Inc., Flexifloat Construction Systems, <http:www.flexi–float.com>.

* cited by examiner

*Primary Examiner*—Ed Swinehart
(74) *Attorney, Agent, or Firm*—McKenna Long & Aldridge LLP

(57) ABSTRACT

An interlocking system, apparatus and methods for connecting floating structures by utilizing a male-female interlocking arrangement of shafts, cams, and connector bodies which manually lock and unlock thereby permitting, when attached to structures, quick and easy connecting and disconnecting of the structures in various states of motion including rough seas.

96 Claims, 17 Drawing Sheets

INTERLOCKING SYSTEM, APPARATUS AND METHOD FOR CONNECTING MODULES

CROSS REFERENCE TO RELATED APPLICATIONS

This application claims priority to U.S. provisional application Ser. No. 60/178,715 filed Jan. 28, 2000.

The United States Government may have certain rights related to this invention pursuant to Contract No. N47408-98-C-7519 awarded by the Department of the Navy, Naval Facilities Engineering Command.

FIELD OF THE INVENTION

The present invention generally relates to an interlocking system, apparatus and method for connecting floating structures by utilizing a male-female interlocking arrangement of shafts, cams, and connector bodies which manually lock and unlock thereby permitting, when attached to structures, quick and easy connecting and disconnecting of the structures at various states of relative motion between floating structures.

BACKGROUND OF THE INVENTION

Floating structures, platforms, or modules can be connected together to form larger structures or larger modules. One example of a connection of modules is a pontoon causeway or pontoon bridge, where many pontoons are attached end-to-end. Other instances of connected water-based structures are modules attached to piers or to the sides or ends of ships. Some other floating structures, for example, are floating docks, bridges, ramps, or rafts. This invention also generally relates to fields where individual interconnected sections, elements, or modules of a structure are generally exposed to loads at their connection points.

These modules, however, once attached to each other, may be generally vulnerable at the point of attachment or otherwise exposed to certain loading conditions that require special consideration due to, for example, highly localized motions. Indeed, the connection between two modules is generally sensitive to external forces, and may be the structurally weakest part of the larger connected modules. For instance, forces generated by wind, current, waves, etc. can each serve to undermine the structural integrity of the connections.

The traditional solution to overcoming these loading conditions has been the development of heavier and larger connectors. These heavier or larger connectors, however, are more costly to fabricate, take longer to deploy, are hazardous to those who work with them, and contain other drawbacks and design deficiencies. In addition, larger and heavier connectors tend to reduce the buoyancy of the module to which they are supporting or to which they are attached.

Other problems with traditional designs include connectors that support only a reduced weight under certain forces and in certain environments, thus limiting the space available for mission success (e.g., storage, transportation). These connectors also experience failures related to fatigue, tension, and compression loading. Another problem with traditional connector designs is that they require multiple types of connectors (e.g., two types of connectors are often required to connect two modules). Again, this requirement for multiple types of connectors increases maintenance, fabrication, manufacturing and supply costs, as well as deployment time. Moreover, inadequate connectors fail to provide the requisite stability for platforms that must provide a certain level of rigidity.

The limitations on predecessor connector designs individually and in concert add tremendous costs and have an inordinate effect on the deployment and use of the platforms intended to be formed by connected sections or modules. In addition, these limitations have extraordinary consequences in time sensitive uses, such as military operations or emergency situations such as flooding or rescue operations, where a pontoon causeway is needed.

A valuable contribution to the art, therefore, is a connection design and method such as the present invention disclosed herein that is able to connect when there is relative motion between floating modules and is individually and in concert stronger, more buoyant, lighter, cheaper, smaller, safer, easily attached, easily connected, easily disconnected, and easily maintained.

SUMMARY OF THE INVENTION

A principal advantage of the present invention is an arrangement, system and/or method for connection which substantially obviates one or more of the limitations and disadvantages of the described prior connection arrangements. The objects of the present invention include providing a connector system, apparatus, and method whereby two locking structures, such as connector fingers or connector bodies, are joined in various states of relative motion between floating structures. A further object of one embodiment of the present invention is to provide connector fingers, one configured to receive the other (a female finger configuration) and one configured to be inserted in the other (a male finger configuration). A further object of the invention includes a method for connecting modules having a male finger connection at one end and female finger configuration at the other end. A further object of the invention is to provide a means for locking modules in a connected position. Another object of the invention is to allow six degrees of freedom within the connection between the modules. Yet another object of at least one embodiment of the present invention is to provide for the connection of modules having similar finger connections at each end (i.e., both male or both female). The configurations of the connections, both male and female, may vary within certain parameters to accomplish these and other objects.

To achieve the objects and in accordance with the purpose of the invention, as embodied and broadly described herein, the present invention relates, for example, to an interlocking connection system ("ICS") that connects modules via interconnecting fingers, male and female, and connector bodies in various states of relative motion between floating structures. In a particular embodiment, the fingers may be tapered. In a preferred embodiment, the invention consists of an arrangement of steel shafts, cams, and connector bodies which, together as male/female elements, can be used to quickly manually lock and unlock floating modules or sections, such as pontoons, in, for example, heavy seas for the purpose of quickly building a pontoon causeway, bridge, ferry, ramp, or other facility or structure. The applications for use of this embodiment of the present invention include, but are not limited to: roll-on/roll-off discharge, load-on/load-off discharge, and causeway ferries or piers.

The male finger assembly may include a casing configured with a camshaft, cams, and connector bodies. The camshaft and cams should preferably be designed to work together to force out and to allow retraction of the connector bodies from a circular hole or receptor in the casing. The camshaft is preferably a tubular shaft and may be supported by rubber-stave or other non-precision bearings. In one embodiment, the cams may be scalloped to prevent the connector bodies in the male connector fingers from turning the camshafts when the connector bodies are under loads in a locked (partial or full) position. The connector bodies are preferably spherical and, in at least one embodiment of the present invention, are assembled to be seated in receivers when forced out by the cams. The connector bodies may also be substantially spherical or balls. A ball may be spherical, oval, oblong, conical, or any other similar shape or combination of shapes. The connector bodies may be any acceptable shape able to effectively distribute loads and be restrained in three directions. The connector bodies and casings are preferably designed to resist all connection loads in shear and in bearing. The connector bodies and casings are also preferably designed to allow for six degrees of freedom within the connection. The female finger assembly may include the same or similar casing as the male finger assembly and need not be configured with moving parts. In a preferred embodiment, the same casing is used for male and female assemblies and the female finger has no moving parts. The circular hole in the female configured casing can be adapted to be used as a receptacle for the connector body from the male configured casing. The combination of receivers and the female configured casing is preferably designed to restrain the connector bodies in three dimensions and support loads in three dimensions while maintaining a connection with six degrees of freedom. The receivers, for example as depicted in FIG. 4, which may be receptor plates, may be shaped in such a way to support connector bodies by being an indented shape that allows for a sphere, substantially spherical shape, ball, or cone to rest in the indentation, allowing the restraint of connector bodies as depicted for example in FIG. 3, in three dimensions and to support loads in three dimensions. Prior to adding a protective sheath to the fingers, the male and female casings can be configured to be exactly the same, or very similar, which is a marked improvement over traditional multiple configuration connector systems and casings.

All components of the fingers may be made of steel, steel alloys, non-ferrous alloys, plastics, or any other type of material suitable for heavy loading, fatigue, stress, or strain.

The male fingers in one embodiment are adapted to attach to a side of a first module and the female fingers are adapted to attach to a side of a second module. Preferably, the sides of the modules are flat. The casings in this embodiment can include holes that allow easy access for various purposes such as for attachment (e.g., welding), for lubricating, and also, for maintenance purposes.

In an alternative embodiment, either the male fingers or the female fingers can be imbedded into a module (i.e., the module can be built with male and/or female fingers designed into its sides). Alternatively, these fingers may be permanently welded or fixably connected in any other acceptable manner.

In an alternative embodiment, a cover is placed on top of the fingers allowing the protruding finger to be flush with the surface of the attached module. In addition, the protruding finger can support substantially more weight than current traditional connecting devices. One such embodiment can, for example, support 15 times more weight than prior connector designs.

In a preferred embodiment, the female fingers, may be placed along a side and separated enough so that a male finger may fit flush within the two female fingers, create a female pocket. Modules may be attached whereby male fingers are made flush with female pockets and the male finger's connector bodies are forced out into a locked position. Specifically, once the fingers are flush with the pockets, the camshafts are rotated. The cams attached to the camshafts then exert a force on the connector body which is then pushed partially out of the male casing and into the female receptor. The camshaft is rotated until it is locked in one of three positions. Attachment (or interlocking) is complete when all the camshafts, of a particular side, are in a locked position. In a preferred embodiment there is a mechanism provided for external locking of the camshaft that comprises a bearing, socket, locking pin or key, and a plurality of poles that may tighten the camshaft into the locked position.

In addition, the design of the male and female fingers of the present invention, when operational, can be configured so that they do not decrease buoyancy. Further, the design of the connector fingers may allow the camshafts to be rotated manually in almost any, if not all, sea conditions and weather.

It is understood that both the foregoing general description and the following detailed description are exemplary and explanatory only and are not restrictive of the invention. Additional objects and advantages of the invention will be set forth in part in the description which follows, and in part will be obvious from the description, or may be learned by practice of the invention.

The accompanying drawings, which are incorporated in and constitute part of this specification, illustrate several embodiments of the invention and together with the description, serve to explain the principles of the invention.

DESCRIPTION OF THE PREFERRED EMBODIMENTS

Reference will now be made in detail to preferred embodiments or exemplary embodiments of the present invention, examples of which are illustrated in the accompanying drawings.

Figure 1:
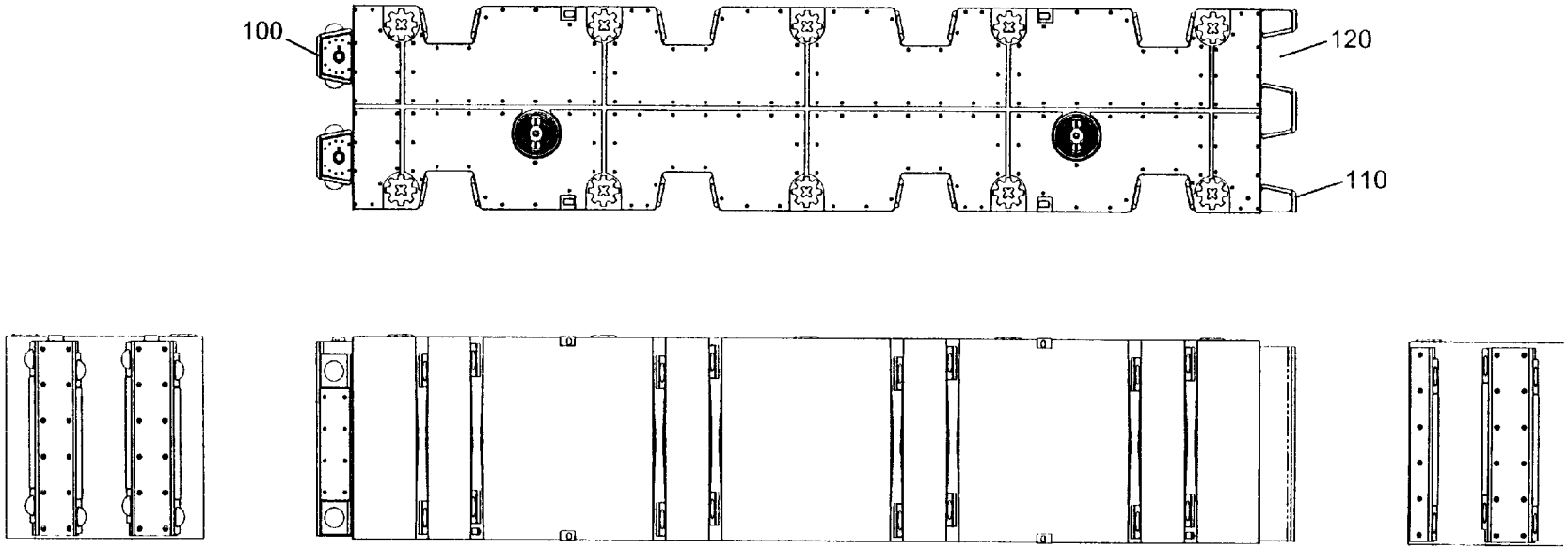
FIG. 1 is an overhead view and the corresponding side view of one embodiment of a connector system arrangement for a flat end module.

The ICS may be divided into two major locking systems, referred to as connector fingers and connector bodies. The connector fingers may be, for example, one male and one female. In an alternative embodiment, the male and female connector fingers are permanently welded to or otherwise similarly fixably connected to the modules. In another alternative embodiment, the fingers may be an integral part of the modules as seen in FIG. 1. In other words, the module has either male and/or female fingers and/or pockets designed into the structure.

Figure 2:
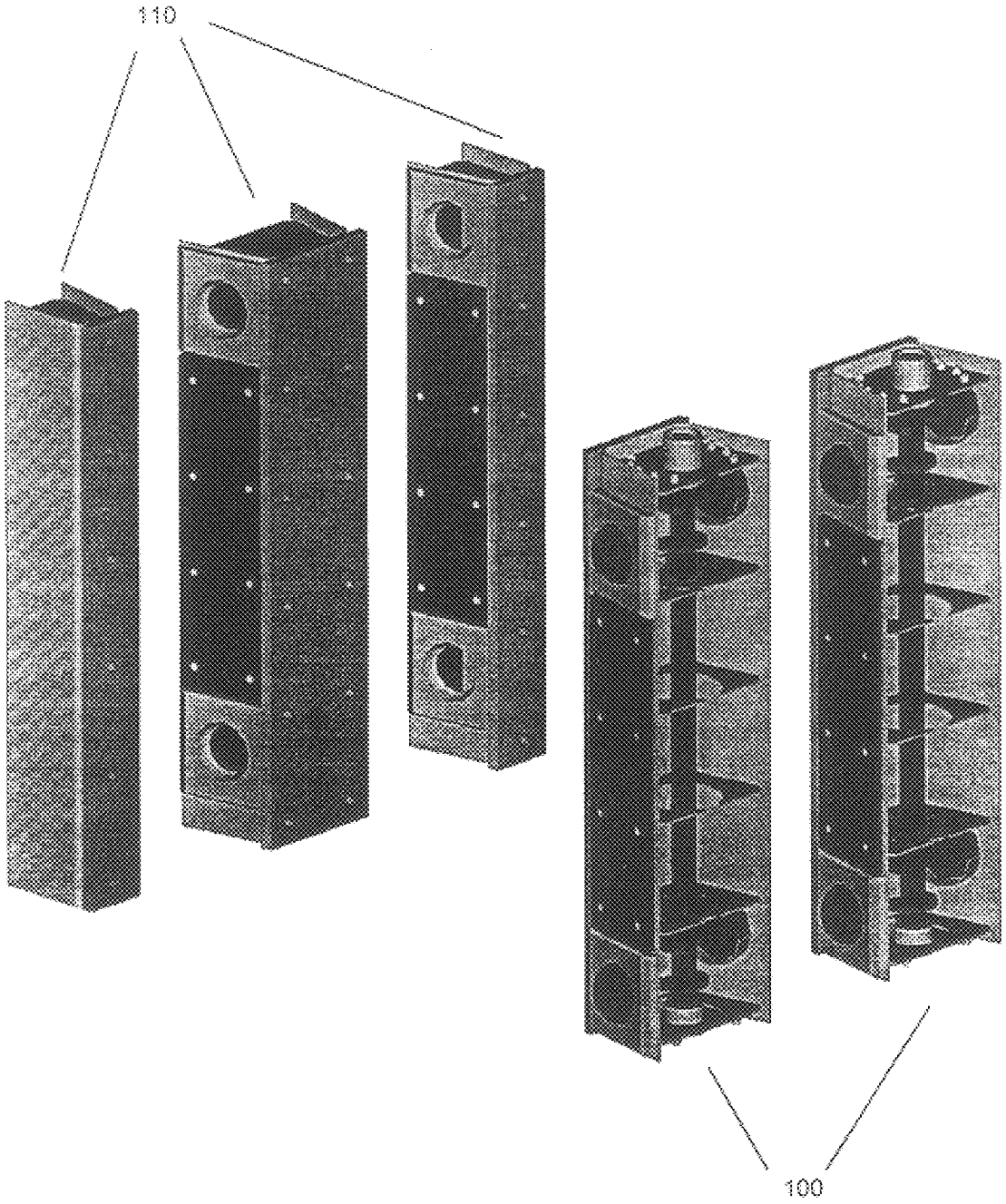
FIG. 2 is depiction of a sample interface alignment and internal component arrangement for one embodiment of male and female connector fingers.

FIG. 1 depicts an overhead view and the corresponding side view of an structure configured as a flat-end module. In this preferred embodiment, both of the two ends are flat, one having male fingers 100 and the other having female fingers 110. Male fingers 100 on one end may connect with corresponding female fingers on a second module whereas the female fingers 110 on the other end may connect with corresponding male fingers on yet another module. Pockets 120, for example, are adapted to receive male fingers 100 from a second module. FIG. 2 depicts a sample alignment configuration of male 100 and female 110 connector fingers. The structures that the connector fingers would otherwise attach to are not depicted.

The finger structures may be outfitted with a sheathing of energy absorbent low-friction plastic or other equivalent materials of extreme toughness and durability. This sheathing facilitates the mate-up of modules and module assemblies and protects the connector and module structure from damage during assembly and subsequent operation. In an alternative embodiment of the present invention, the design of the male and female fingers includes the minimum required UHMW sheathing so as to maximize the reduction in weight and reduction in costs for floating modules. In yet another alternative embodiment, the design of the male and female fingers utilizes casting material that is selected for moderately high strength and hardness commensurate with weldability.

In an alternative embodiment, the design of the male and female fingers includes access holes which allow for post-welding and cyclical maintenance (e.g., re-coat). Additionally, mechanisms contained in the male finger are preferably adapted so that they can be lubricated for easier operation.

Figure 3:
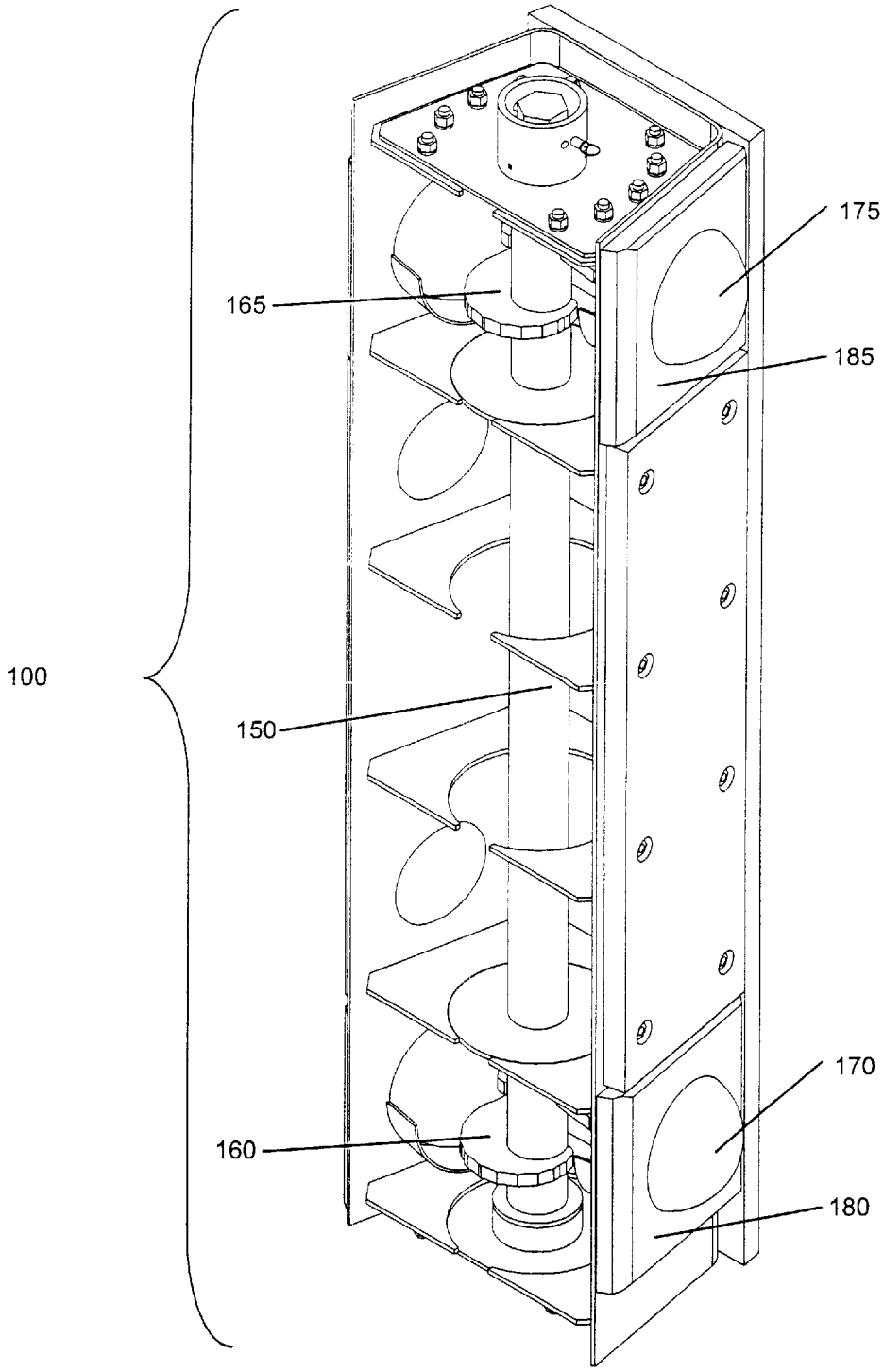
FIG. 3 is an interior view of one embodiment of a male connector finger.
Figure 17:
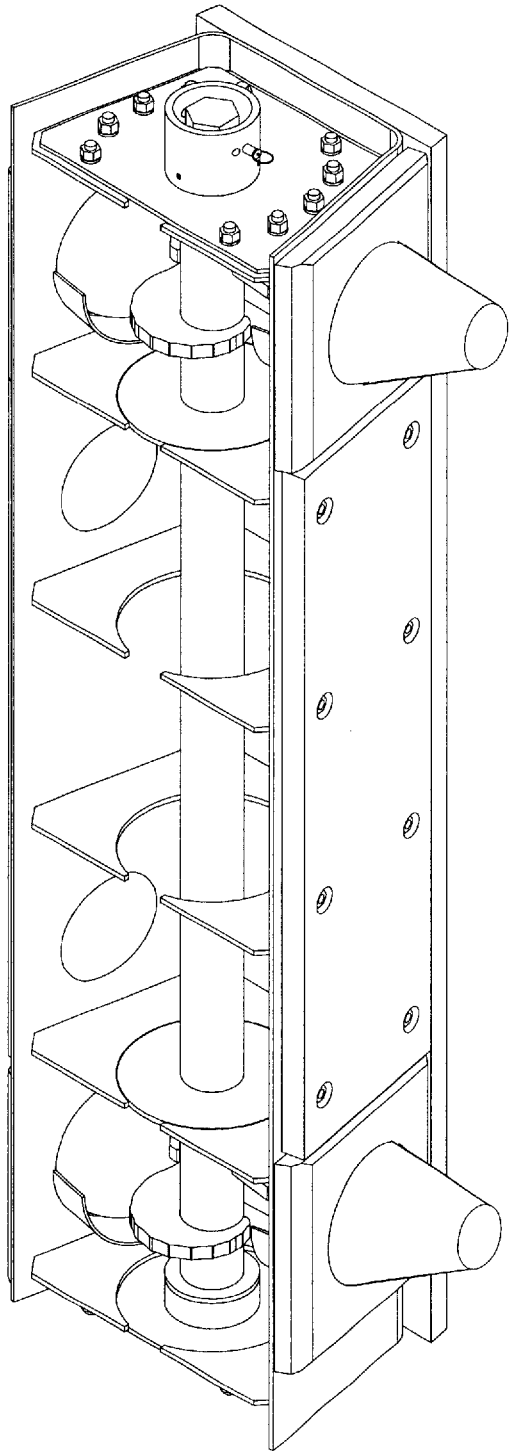
FIG. 17 is an interior view of one embodiment of a male connector.

FIG. 3 depicts an interior view of a male connector finger 100. The male connector fingers have a rotatable camshaft 150 with cams 160, 165 attached which alternately force locking connector bodies 170, 175 out of male finger 100 or allows those connector bodies to retract into the finger. The connector bodies may be spherical, substantially spherical, or balls. A ball may be spherical, oval, oblong, conical (as shown, for example, in FIG. 17) or any other similar shape or combination of shapes. The connector bodies are seated in receivers 180, 185 on male connector finger 100 when forced out by cams 160, 165. Once the structures are aligned and in close proximity to each other, camshaft 150 within the male finger 100 shown in FIG. 3 is turned. Unlike prior connectors, the structures may be loosely aligned and relative motions of the fingers and/or floating bodies in six degrees of freedom may be present, before, during and after connection. The cams 160, 165, when turned, create an interlocking connection by forcing connector bodies 170, 175, for example, spheres, to move outwards and into the female finger's circular receptors 200, 210 shown in FIG. 4. Connection may occur at various states of relative motion between floating structures.

Figure 5:
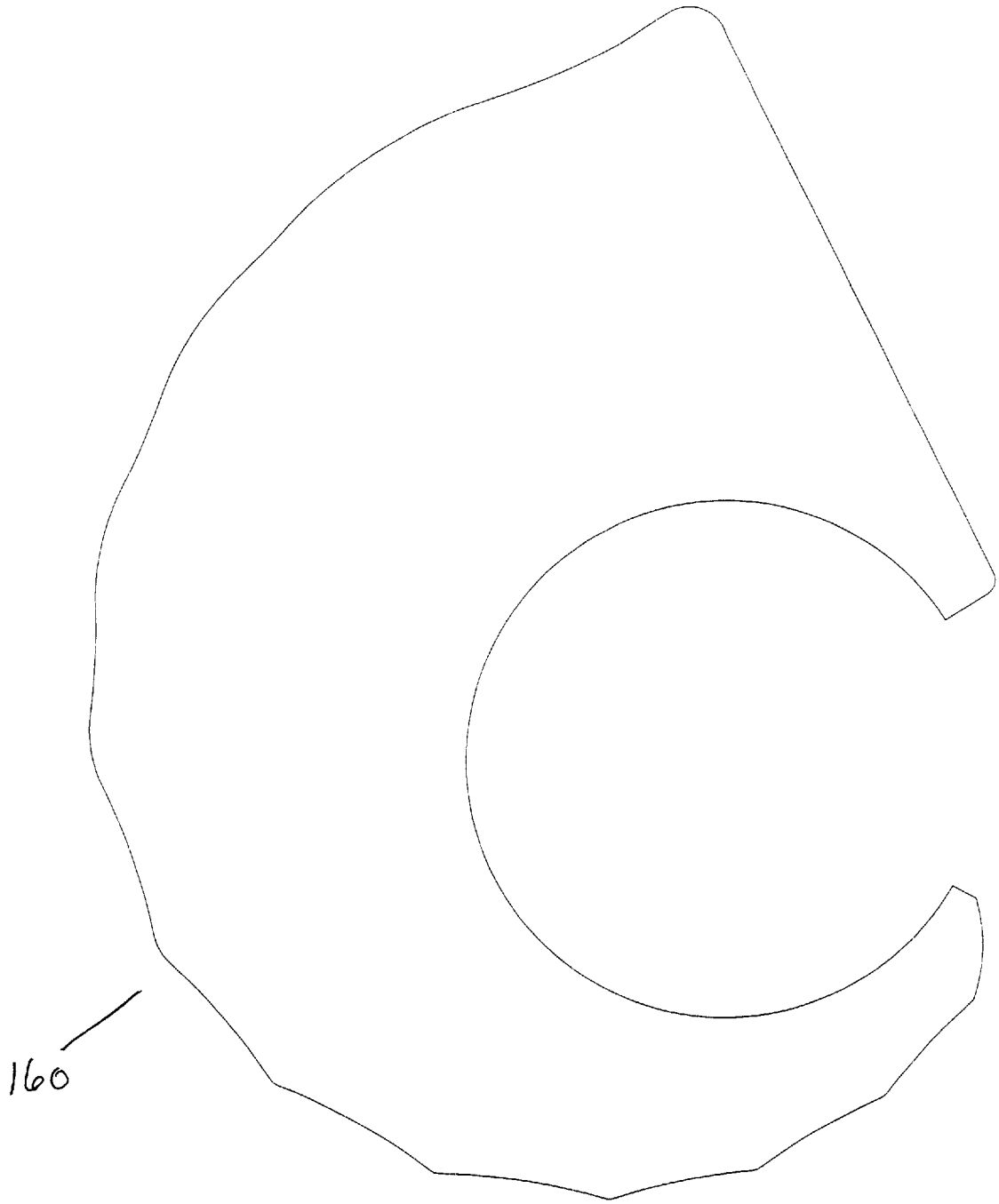
FIG. 5 is a top view of one embodiment of a locking cam.

In an alternative embodiment, the cams can be scalloped to prevent the connector bodies, preferably spheres, in the male connector fingers from turning the camshafts when the connector bodies are under loads in a locked (partial or full) position, providing an additional safety feature. FIG. 5 depicts one configuration of a locking cam 160. A connector body seated in one of these scallops will apply no force on the cam which would tend to rotate the cam shaft. Alternatively, the cam may include various notches, indentations and movably mounted latches for rotatably locking and unlocking.

Figure 4:
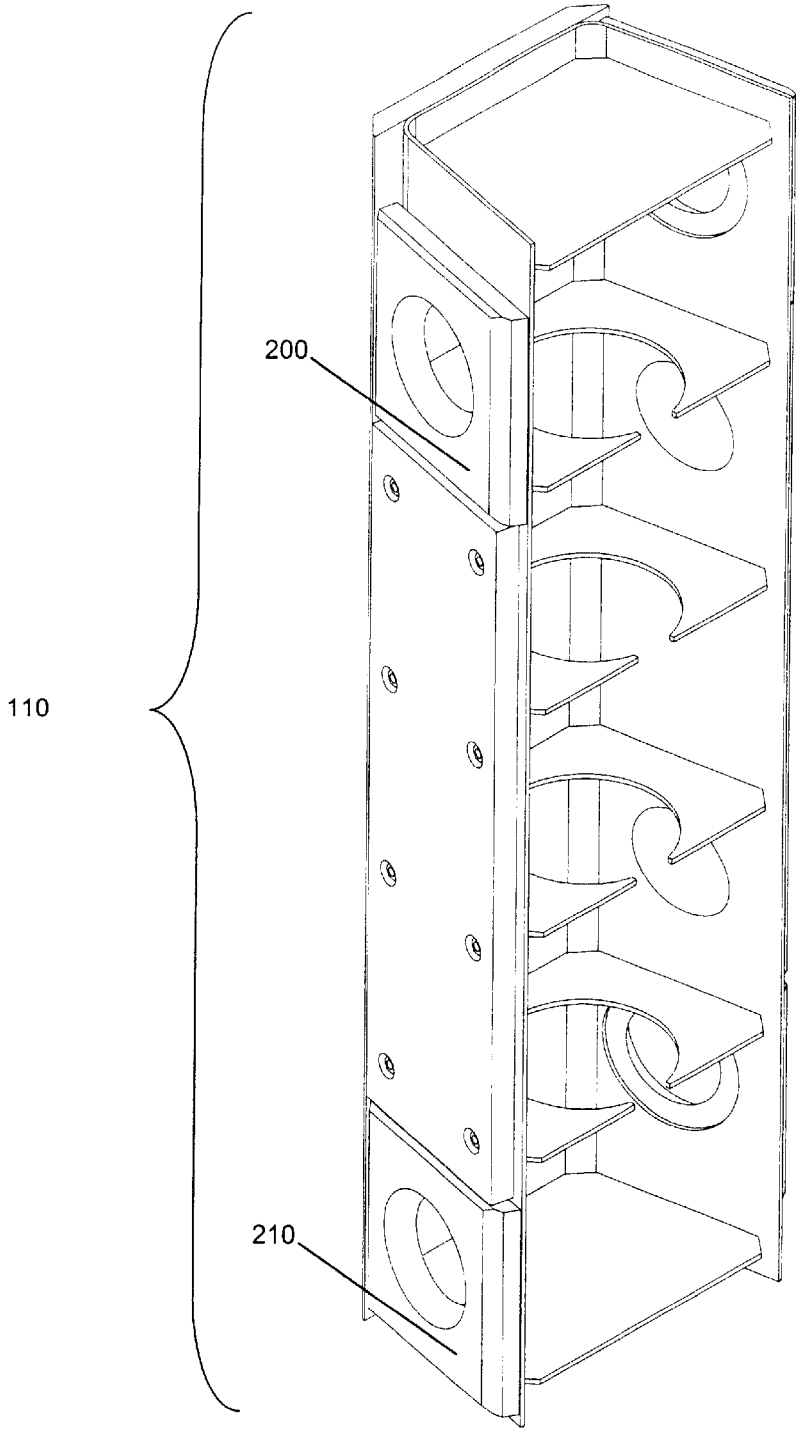
FIG. 4 is an interior view of one embodiment of a female connector finger.

FIG. 4 depicts an interior view of a female connector finger 110. The female fingers are not required to have and may not have moving parts and in at least the embodiment of FIG. 4 are not operated in any manner to accomplish a connection of modules or module assemblies. The receptors 200, 210 are preferably shaped like indentations of the connector bodies, designed to restrain connector bodies 170, 175 in three dimensions and to support loads in three dimensions in various states of relative motion between floating structures. The receptors 200, 210 may be cast to have a concave surface and manufactured with tight tolerances to withstand high levels of stress.

In an alternative embodiment, male and female finger assemblies are identical until receivers and/or connectors are added. Identical assemblies or housings reduce tooling costs and fabrication costs. In another alternative embodiment, the male and female fingers can be very large, as to support sea-based structures, medium, or small, as to attach to and connect smaller structures, such as those found in a household.

In an alternative embodiment, the interlocking connection is adapted to be manually locked and unlocked. In this embodiment, the male finger and female finger design exerts minimal force on the camshaft and cam mechanism thereby making it possible for the camshaft to be manually turned with minimal force to either lock or unlock the connector body connection. In an alternative embodiment, all the camshafts which are flush with female pockets are adapted so that they can be turned simultaneously. In addition, the camshafts may be turned in successive order or simultaneously, but in successive degrees of force. The turning of the camshaft forces the locked connector bodies out of the male finger or allows those connector bodies to retract into the male finger.

The manual locking mechanism may comprise the camshaft, cams, connector body configuration, a bearing, preferably a propeller bearing, a socket, and a plurality of poles used as levers for tightening the position of interconnection of modules. In the locked position, the extended connector bodies and receivers, and the interlocked fingers, form a strong mechanical joint. A high degree of strength is achieved even if the connector bodies are not fully extended.

The ICS can, thus, be deployed in severe conditions, such as, for example, heavy seas, storms, wind, and current, as well as conditions where any forces are exerted downward by any payload (or force) residing on top, in, or below the modules, allowing connection in various states of relative motion between floating structures.

Figure 6:
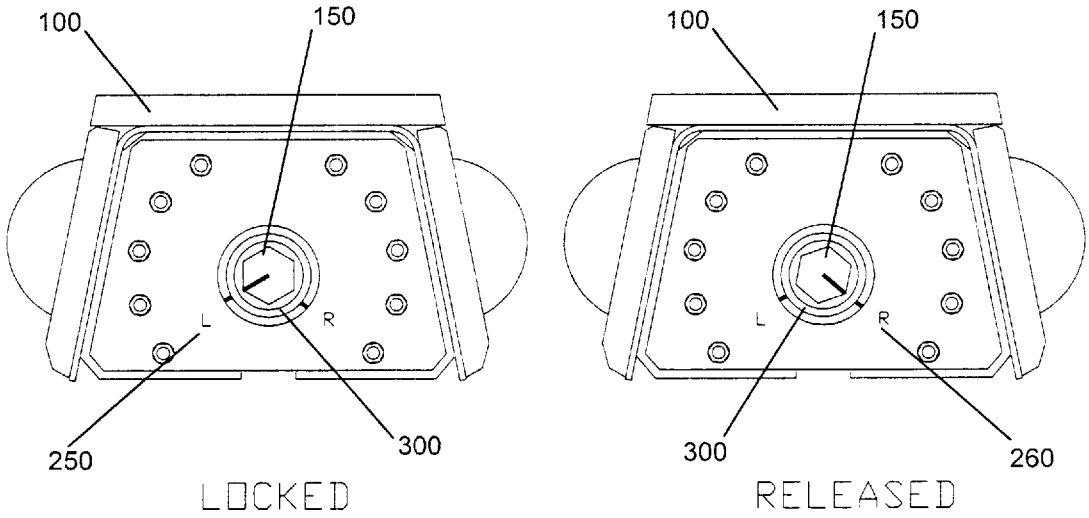
FIG. 6 is a top view of one embodiment of a camshaft and bearing housing on a male connector including reference markings.

FIG. 6 depicts the top of an embodiment of a camshaft 150 and bearing housing 300 which depicts a dual positioning system for locking and unlocking the connector bodies. Reference markings 250, 260 on the tops of the connector fingers 100 show when camshaft 150 is in a locked or unlocked position or how far camshaft 150 must be turned to put the finger into a locked or unlocked position.

Figure 7:
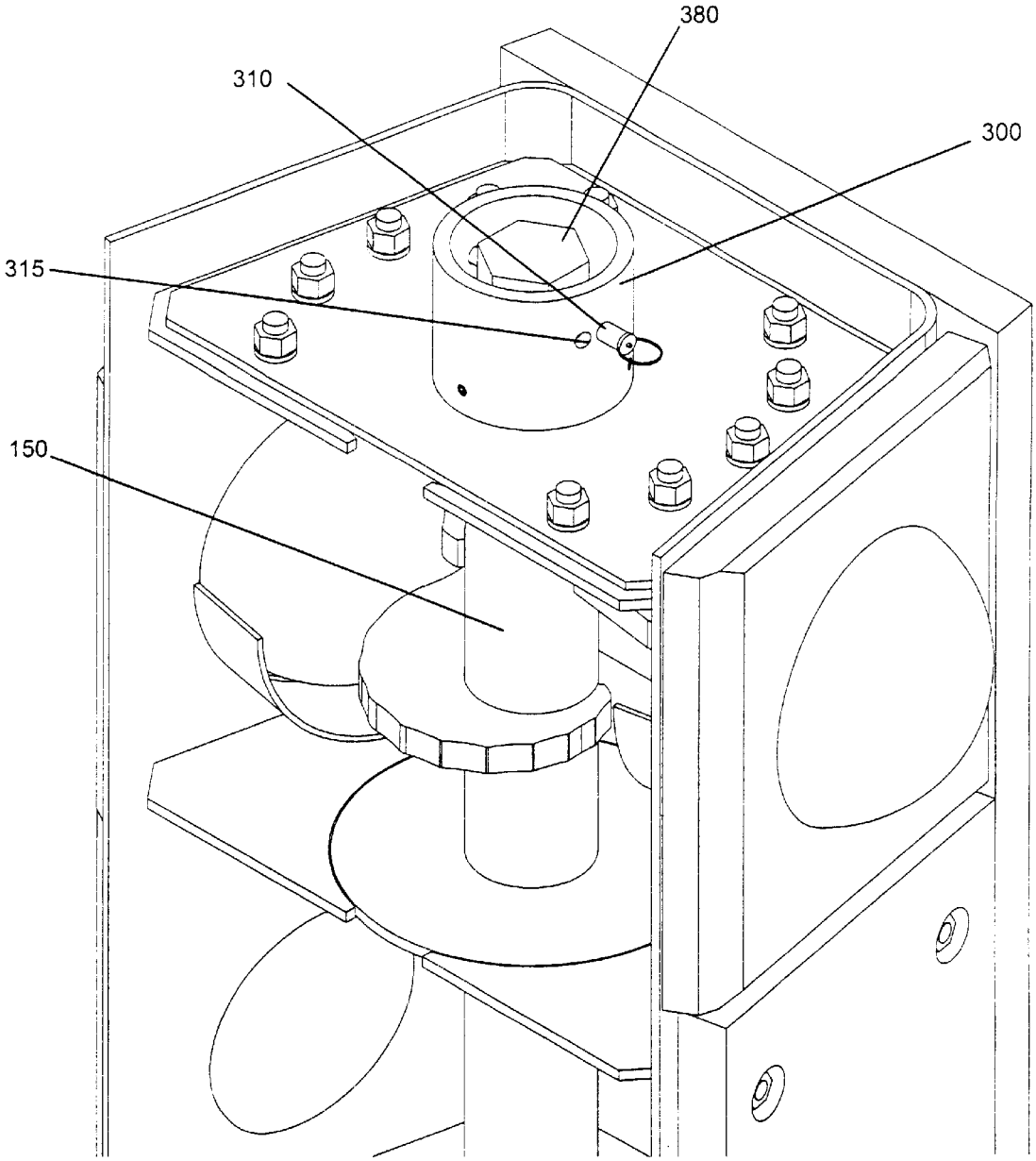
FIG. 7 is an interior view of one embodiment of a male connector finger depicting a shear pin located in the bearing housing.

FIG. 7 depicts an embodiment of a safety shear pin 310 included in the connector assembly. The safety shear pin 310 is provided to ensure the safety of the modules' operator by preventing camshaft 150 from potential rotation or translation due to vibration or cyclical working of the ball on the cam, which can occur, for instance, when the ICS is deployed in a seaway. The pin also prevents/controls inadvertent unlocking of both sides of a male-male connector.

Figure 8:
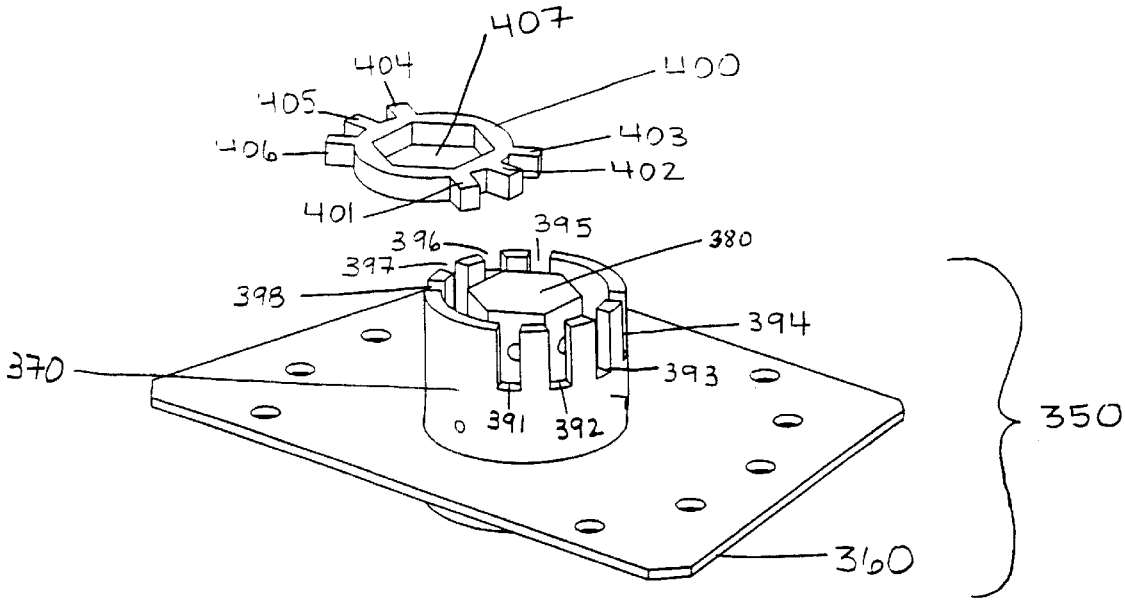
FIG. 8 depicts one embodiment of an altered bearing plate assembly that connects male finger connecting bodies and shaft to a tightening device for the system and a corresponding locking key.

FIG. 8 depicts an embodiment of altered bearing plate assembly 350 that connects the male finger connecting bodies and shaft to a tightening device for locking the system. The bearing plate assembly 350 as shown connects to a male finger. The camshaft on the male finger (not shown) has a bearing. Bearing plate 360 may be attached to the top of the bearing. Bearing plate 360 is preferably altered to have a cylindrical socket 370 pass through it, with a hex head 380 on the top side (capstan assembly side) of the bearing plate of cylindrical socket 370. Hex head 380 is preferably surrounded by cylindrical socket 370, adapted to have eight slots 391–398. The eight slots may be used to provide two locking positions. Bearing plate 360 preferably has holes to interface with protrusions atop a male finger for removably mounting bearing plate assembly 350 to a male finger.

Figure 9:
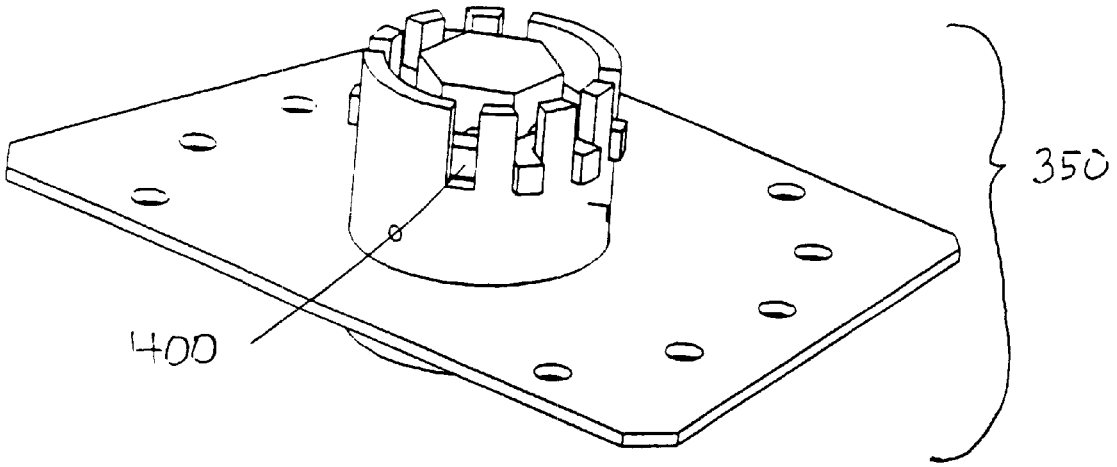
FIG. 9 depicts the correct alignment of one embodiment of a locking key and altered bearing plate assembly.

A locking key 400, also shown in FIG. 8 preferably has six flanges 401-406 and a hollow center 407, cut in such a manner so that the eight slots in the cylindrical socket 370 are aligned with the six flanges on locking key 400 and hollow center 407 of locking key 400 fits over hex socket 380. FIG. 9 illustrates the correct alignment of a locking key 400 and an altered bearing plate assembly 350.

Figure 10:
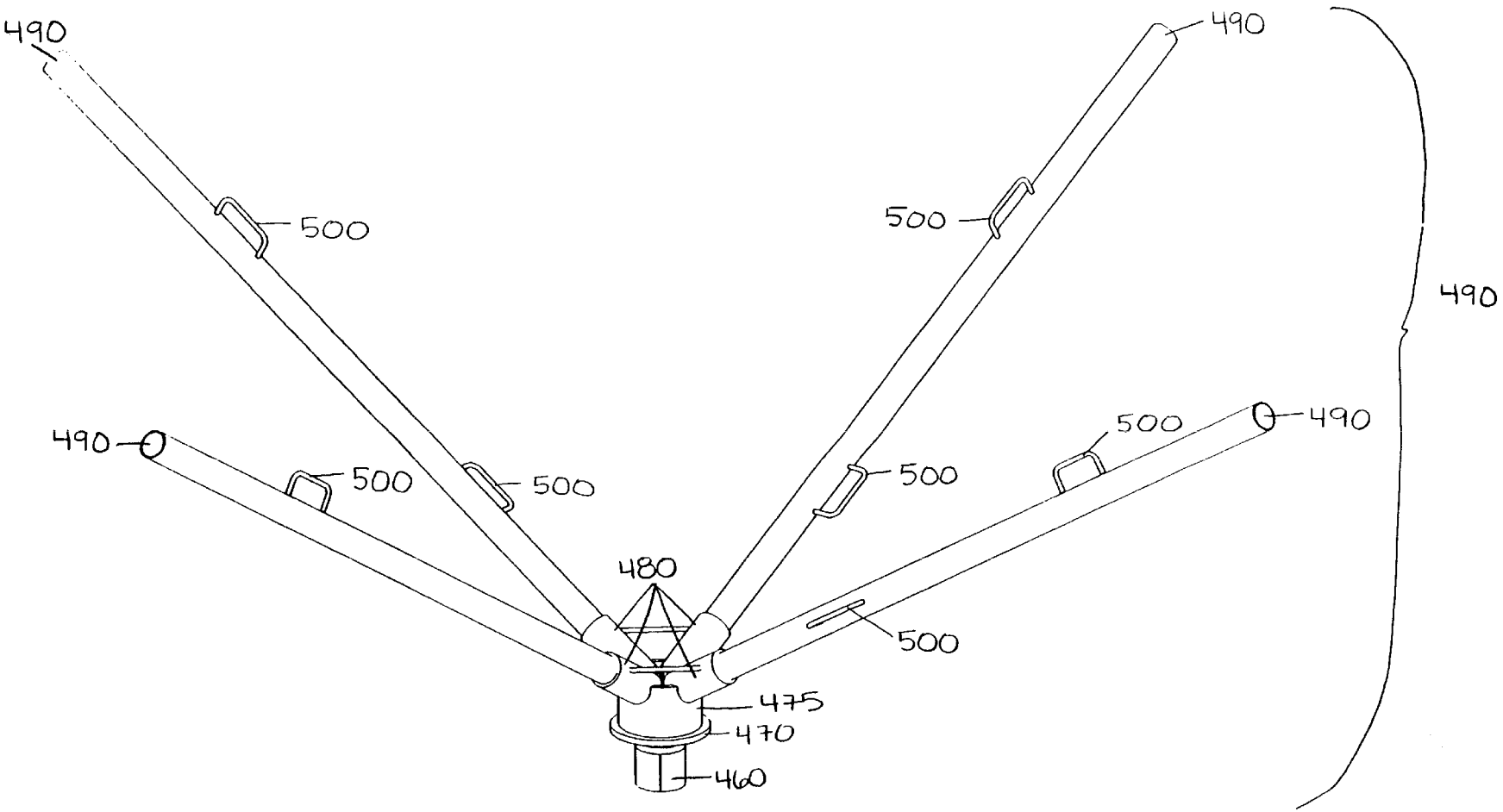
FIG. 10 depicts one embodiment of a capstan socket assembly for tightening the locking system comprising a socket, adapted connector, and a plurality of poles which may be used as levers to allow the locking system to be tightened.

Referring to FIG. 10, in a preferred embodiment of the present invention a capstan socket assembly 450 may be used in conjunction with altered bearing plate assembly 350 of FIG. 8 to allow the locking system to be tightened. Capstan socket assembly 450 may include a socket 460, a socket plate 470, an adapted connector 475, one or more capture pipes 480, one or more tightening poles 490 (lever pipes), and one or more grip handles 500. Capstan socket assembly 450 preferably fits over the hex head of the bearing plate assembly. The capstan socket 460 is also connected to a socket plate 470. The socket plate 470 may be a circular plate with a socket base pipe attached to it. The adapted connector 475 socket base pipe is preferably a hollow cylinder adapted to have a plurality of capture pipes 480 attached to it. Capture pipes 480 are preferably pipe-like or tubular and are of larger diameter than tightening poles 490. Tightening poles 490 preferably have a smaller diameter than capture pipes 480 to allow a them to fit concentrically within capture pipes 480. Tightening poles 490 are preferably cylindrical with a length sufficient to allow for a mechanical advantage, for example, to be used as levers and to ensure the safety of the operators by being of sufficient length that an operator need not be at the edge of the module for connection. Each tightening pole 490 preferably has at least one grip handle 500 attached to it to facilitate better grip.

Figure 11:
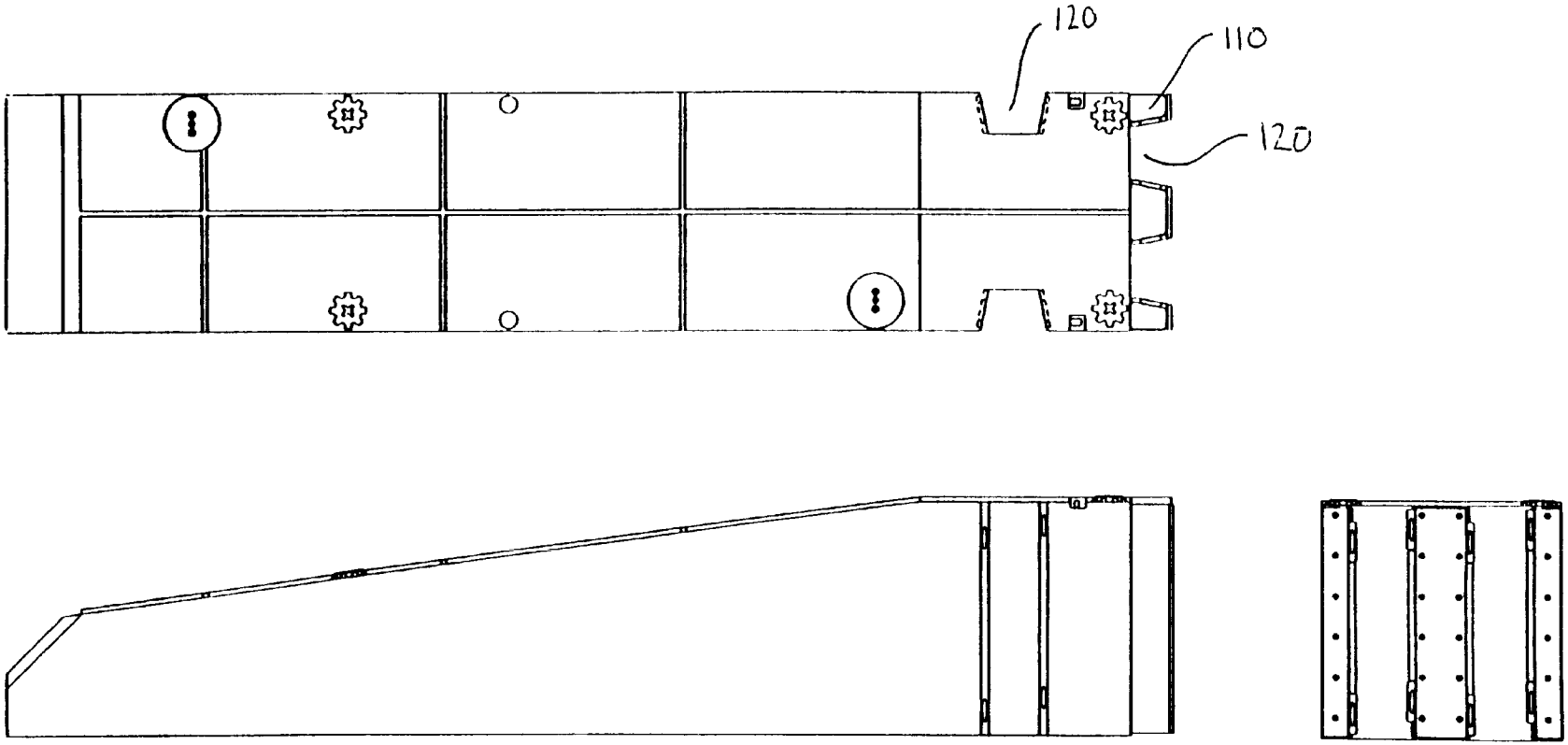
FIG. 11 is an overhead view and the corresponding side view of one embodiment of a ramp end module.

In another alternative embodiment of the present invention, modules which are designed to be assembled only at the extreme ends of an ICS (i.e., at the ends of a causeway) have either male connector fingers or female connector fingers at their connectable flat end. In yet another alternative embodiment, modules which have a ramped end and a flat end will be equipped with either male or female fingers or both on the flat end. Ramped-end structures are used to load and off load equipment and people when traditional ports are unavailable, which is the case in many military applications. FIG. 11 represents a ramp end module. In an alternative embodiment, as depicted in FIG. 11, the ICS design when applied to a traditional ramp-end module includes an integrated connector design. In other words, the module has either male and/or female fingers 100, 110 and/or pockets 120 designed into the structure. In addition, the ICS design includes side connectors or pockets 120 which enable deployment of super-assemblies.

Figure 12:
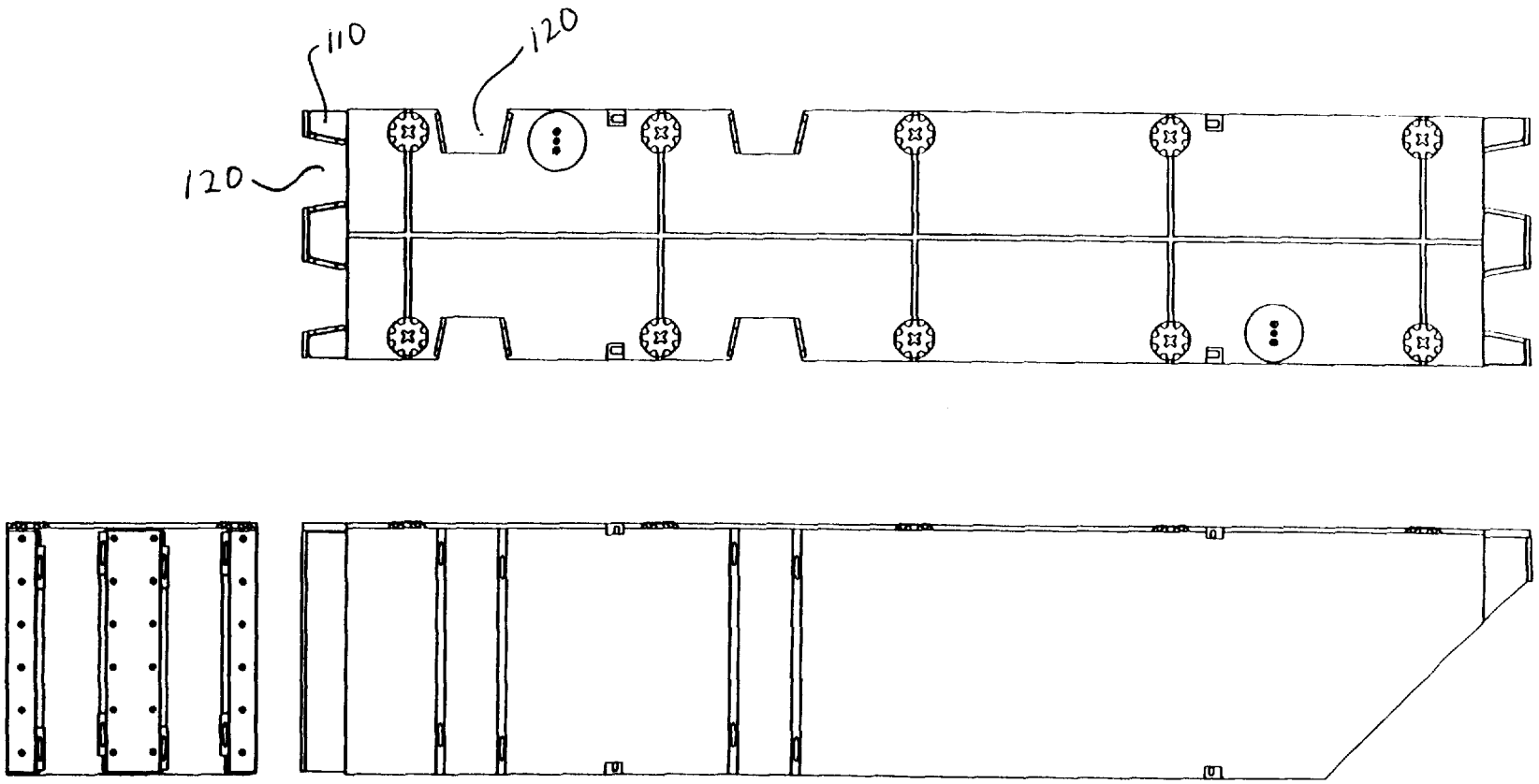
FIG. 12 is an overhead view and the corresponding side view of one embodiment of a ramp end module.

In an alternative embodiment, as depicted in FIG. 12, the ICS design when applied to a traditional rake-end module includes an integrated connector design. In other words, the module has either male and/or female fingers 100, 110 and/or pockets 120 designed into the structure. In addition, the ICS design reduces the number of side connectors and/or pockets 120 required to two. In a further alternative embodiment, modules which have a raked end and a flat end will be equipped with either male or female fingers 100, 110 on the flat end as shown in FIG. 12.

Figure 13:
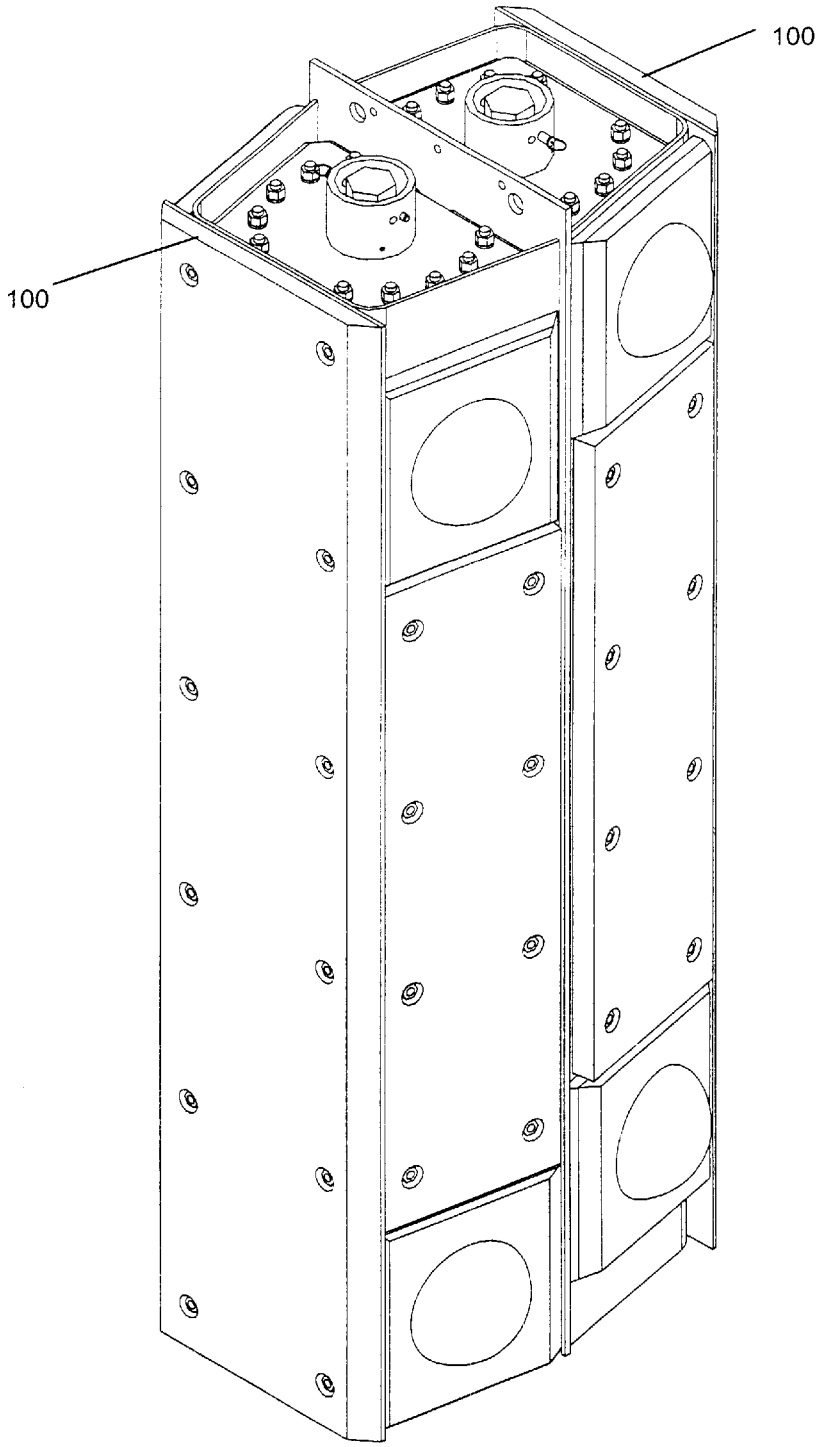
FIG. 13 is an exterior view of one embodiment of a male-male connector assembly.

FIG. 13 depicts an embodiment of a male-male connector assembly. When the male fingers 100 are interlocked and vertically aligned with opposing female connector fingers, the connector bodies are also seated in receivers on the female finger. The connector bodies can seat in the female receivers with some misalignment and will subsequently force the connectors into alignment. In an alternative embodiment, the male-male connector is pre-installed (such as prior to deployment or on a ship's deck) on one side of a structure in a pocket and is then operated as a male connector during subsystem assembly.

In another alternative embodiment, female pockets can be imbedded into a structure's sides and/or ends. A female pocket can be defined as the space (i.e., pocket) that is created when two female fingers are aligned in succession. Alternatively, it may be any integral space in a structure adapted to receive one or more male fingers. In an alternative embodiment, modules may be side-to-side connected by utilizing a male-male connector assembly in two opposing female connector pockets, which are located along the edges of each module.

The ICS's connectors may alternatively be designed to prevent damage to the connectors themselves and to the modules, during the impacts and misalignments expected during water or other installation. Such protective designs include, for example, providing scalloped ball cams to prevent the balls from turning the camshafts when the balls are under loads in a locked position. When the connectors are adapted this way, the connector operators (or installers) can position themselves well away from the deck edges of the connecting joint, at the full extent, for example, of ratchet extension handles. The connectors can then be ratcheted by the operators to achieve locking when super-assemblies are aligned by actions of, for example, assembly tugs and/or sea-induced motions.

One preferred embodiment of a connector body interconnection (i.e., one sphere interconnected to one female receptor pocket) demonstrated that it can withstand 500,000 lbs. of pulling force. This embodiment also demonstrated that casting failure is strengthened fifty percent over traditional castings. The ICS design of the present invention has also demonstrated the ability to withstand side loads on finger piers fifteen (15) times higher than on traditional systems, such as, for example, Flexor connectors as designed by the U.S. Navy's Exploratory Development Program.

Alternative embodiments of the present invention are envisioned wherein the male and female finger designs (i.e., size and scantling) are of reduced weight and improved buoyancy using advanced materials and shapes over traditional designs. Alternative embodiments of the male and female finger design also provide for maximum connector body vertical spacing. Such a design allows for increased longitudinal bending strength. The male and female fingers can also be fitted with a cover which allows the top of the finger protrusion to be flush with the deck that the finger is otherwise attached to.

In the preferred embodiment, the male and female fingers, camshaft, cams, and connector bodies, preferably spheres, are made of steel. In an alternative embodiment, the male and female fingers, camshaft, cams, and connector bodies, for example spheres, can be individually or in total made of non-steel material.

The following exemplary connection and disconnection procedure is illustrative only, and not limiting of the remainder of the disclosure in any way whatsoever. In this embodiment of the method of the present invention, two floating mobile super-assemblies can be connected by the following procedure when various states of relative motion between floating structures exist. Module super-assemblies are first maneuvered into position for connection. Prior to bringing two super-assemblies together for connection, all male connectors are preferably placed in the released position. The connector camshafts may be operated utilizing any 1-inch drive ratchet and 3-inch socket or a capstan socket assembly. The ratchets are modified to provide: a handle extension providing additional leverage and deck clearance for the operator's hands; a groove on the outside of the socket which can be aligned with the mark on top of the hex and enables the position of the camshaft to be determined without removing the socket; and stamped letter marks on the ratchet directional control lever which show the proper position for locking (L) a connector or for releasing (R) a connector.

In this embodiment, the connector is in the released position when the mark on the hex (or on the socket) is aligned with the mark on the bearing housing which is labeled with an (R) 260 on the bearing housing support plate, as shown in FIG. 6. The connector is released by rotating the camshaft clockwise from the locked position. The connector is locked by rotating the camshaft counter-clockwise from the released position. Preferably, the connector achieves full strength at cam positions up to 60° short of full lock. This preferred feature ameliorates the need for exacting fit-up tolerances on connecting modules.

All male connectors involved in the connection interface for this embodiment of the method of the present invention are preferably placed in the released position. For initial lock-up of a super-assembly, two connectors can be operated by two personnel, one per connector. If only two connectors are operated for initial lock-up, they should preferably be those located at the extreme ends of the joint being locked-up. For those connectors being operated, the ratchets and/or sockets may remain on the camshafts with operating personnel positioned inboard approximately 3 to 4 ft. from the deck edge, providing a higher level of safety for personnel. The ratchet direction lever is placed in the (L) position 250, which allows for only a counterclockwise rotation of the camshaft by the ratchet. Once the super-assembly to be connected for this embodiment of the method of the present invention is maneuvered into mating position with another super-assembly or a partially assembled subsystem, the camshafts are preferably rotated counter-clockwise to accomplish initial lock-up. Mating position does not require exact alignments of modules, only preferably a general alignment between male and female fingers. Motions of the fingers and/or floating bodies in six degrees of freedom may be present, before, during and after the locking process and the connectors themselves may attenuate and eventually eliminate relative motion between modules as part of the connection process. The personnel operating the connectors can preferably observe when the connection fingers are interlocked and when relative heave and pitch motions allow for connection. The connector body lock system can preferably achieve a strong connection as soon as the connector body is extended even part way into the female receiver. As the modules work in the seaway and are forced together by the assembly, the connector personnel can preferably "take-up" on the ratchets or turn lever pipes in order to bring the camshaft as near to the fully locked position as possible.

At some point in the connection process for this embodiment of the method of the present invention, it may prove effective to move to other connectors and to ratchet or turn them as near to the fully locked position as possible. This method may include having personnel on every connector when bringing together super-assemblies which have relative trim or heave misalignment. Operating all connectors simultaneously can provide maximum "pull-together" force. However, any working of the super-assemblies in a seaway should preferably allow for locking-up of super-assemblies by simply ratcheting or turning the connector bodies out when the relative motions allow for the connector bodies to be extended further.

To complete the locking of a joint in one embodiment of the method of the present invention, it is desirable to rotate all camshafts counter-clockwise such that the camshaft mark is aligned with the locked (L) mark 250 on the bearing housing as shown in FIG. 6. However, the ICS preferably has full strength at camshaft positions short of full rotation (e.g., 1 to 2 inches short of aligning the hex and bearing housing marks). After the complete assembly of a subsystem, it may prove useful to check all connectors to ensure that maximum possible lock-up has been achieved.

After maximum possible lock-up has been achieved by the method of an embodiment of the present invention, the safety shear pin 310 can be placed through the bearing housing 300 and camshaft hex 380 of FIG. 7. Camshaft 150 may have to be rotated towards the released position (clockwise) to align the nearest holes 315 for the safety shear pin 310.

When pre-installing a male-male connector in a super-assembly side pocket by an embodiment of the method of the present invention, the safety shear pin 310 can additionally be safety-wired in place. When connecting/disconnecting super-assemblies, the safety-wired side of the male-male connector should preferably not be operated. If both sides of a male-male connector are released, the connector can fall vertically, e.g., to the bottom of the seabed.

In another embodiment of the method of the present invention, the process is basically the same, except for the tooling used for lockup. In this embodiment, rotation of the camshafts is preferably done externally by using an altered bearing plate assembly 350, locking key 400, and a capstan socket assembly 450 arranged to allow the insertion of a locking key 400 as, for example, illustrated in FIGS. 8, 9 and 10. Locking key 400 is preferably designed to prevent camshaft 150 and cams 160, 165 from rotating once maximum possible lock-up has been achieved. In a preferred embodiment, when the two structures are interlocked together by fitting the male fingers 100 located in the first structure into the pockets created by the female fingers 110 on the second structure, a capstan socket assembly 450 may be placed over the hex head 380 on the altered bearing plate 360. Once the structures are aligned and in close proximity to each other, personnel may grasp grip handles 500 and apply pressure to tightening poles 490, causing tightening poles 490 to turn hex head 380, which causes camshaft 150 within the male finger 100 to turn. The camshaft 150 then forces, through the use of cams 160, 165, the connector bodies 170, 175 into the female finger's circular receptors 200, 210, creating an interlocking connection. Once the connection is complete, the capstan socket assembly 450 may be removed, and a locking key 400 may be placed within cylindrical socket attachment 370, around the hex head 380, to ensure that the cams 160, 165 and camshaft 150 do not rotate connector bodies 170, 175.

Figure 14:
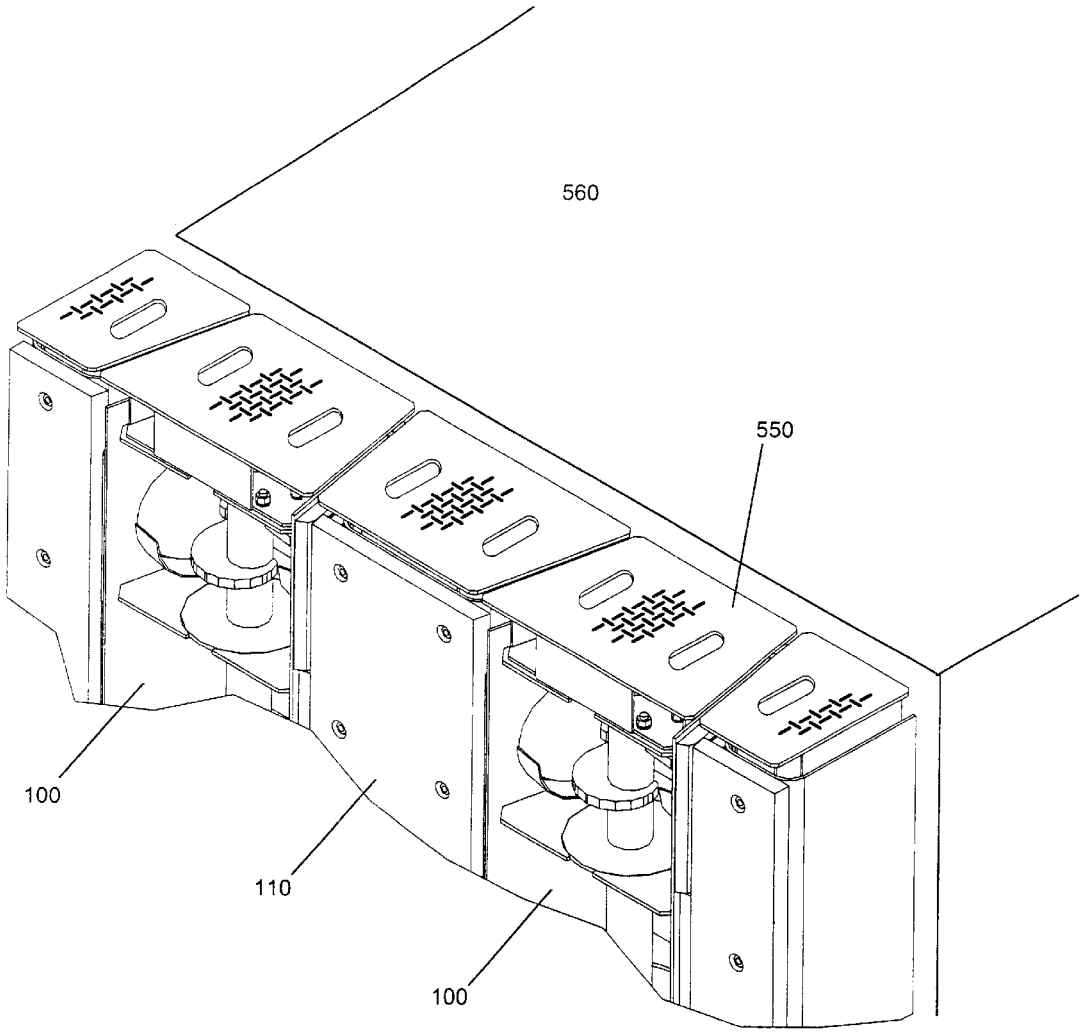
FIG. 14 is the side assembly and interior view of one embodiment of multiple fingers including cover plates which can be fitted over the tops of the connector fingers.

In another embodiment, shown in FIG. 14, once the capstan socket assembly 450 is removed, the male and female fingers 100, 110 may be fitted with a removable cover plate 550 which covers the hex socket and cylindrical socket assembly, allowing the top of the fingers 100, 110 to be flush with the deck 560, preventing an unsafe protrusion or pocket in or above the deck of the structure.

In another embodiment of the method of the present invention, the preceding procedures can be followed in reverse order to disconnect the structures.

Figure 15:
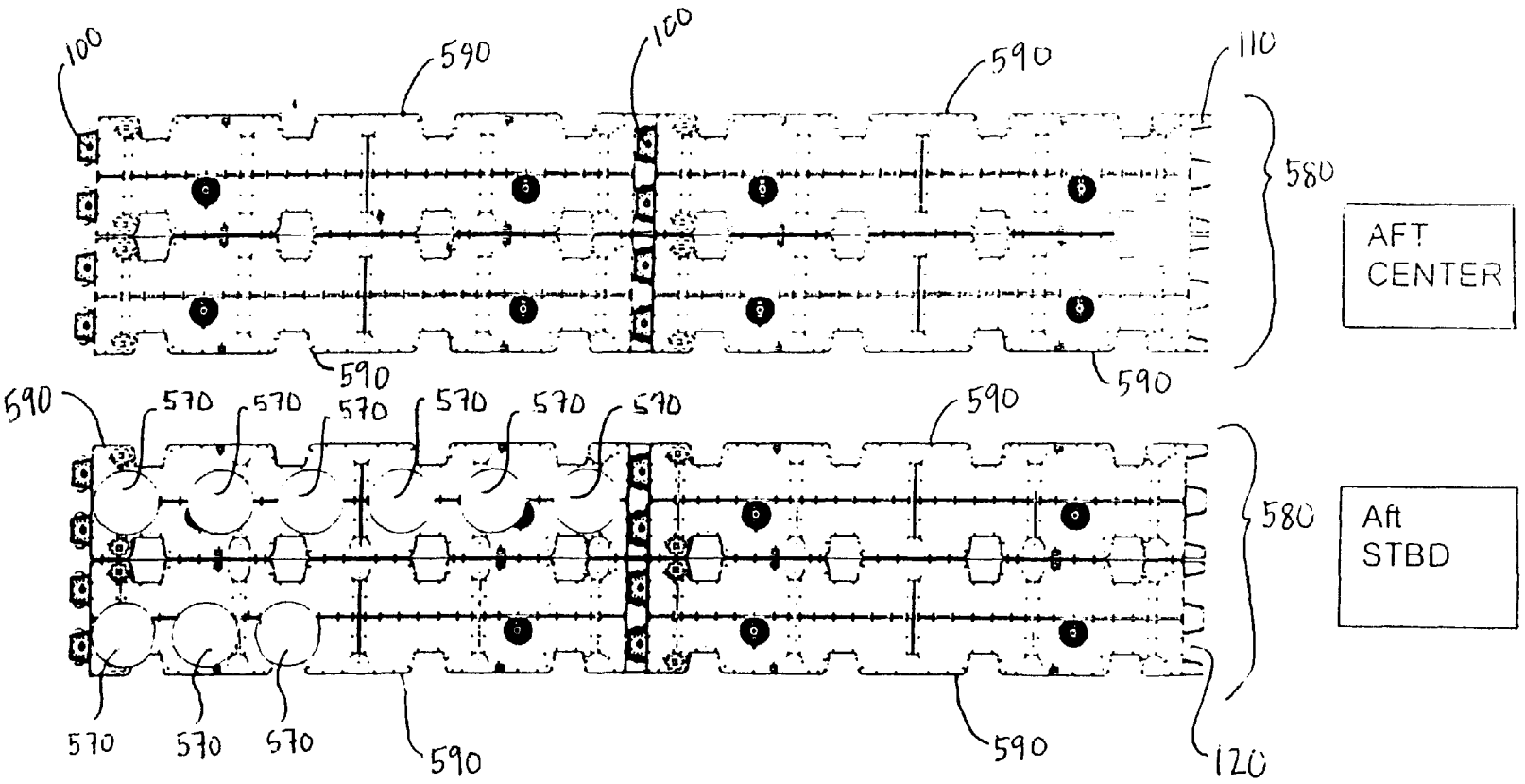
FIG. 15 top view of one embodiment of a ballast arrangement that simulates a CF aft starboard 2×2 super-assembly and an aft center 2×2 super-assembly.

In yet another embodiment of the method of the present invention, the following procedures can be followed to connect two floating super-assemblies 580 side-to-side, (i.e., two 2×2 super-assemblies 580 each consisting of four flat end modules 590 joined by male-male connectors 100, 100 and arranged per FIG. 15). Ballast tanks 570 in the quantity and location shown can be placed on deck as shown in FIG. 15. These assemblies can be constructed on land and then lifted by crane into the water. Once in the water, the ballast tanks 570 can be filled with seawater. The 2×2 assemblies 580 can then be joined together to form a 4×4 platform. This platform will measure approximately 80 ft.×32 ft. Sufficient water depth should preferably be present to float the assemblies 580 (4 ft.) and allow push-boats to maneuver.

One embodiment of the procedure described generally for forming a 4×4 platform begins with the two 2×2 super-assemblies 580 in the water. Next, the connectors 100 are ratcheted to full lock-up position if they were not at full lock-up position on land. Afterwards, 550-gallon ballast tanks 570 may be placed on the assemblies per FIG. 15 and can be filled with seawater. Next, using push boats and bulbhook mooring lines, the male-male connectors 100, 100 of the super-assemblies 580 are aligned with the female connector pockets 120 of the mating super-assembly. The modules 590 are then pulled or pushed together until further movement is prevented by contact of the mating surfaces. Movement may be accomplished with lines bulbhooked into the module cloverleafs and/or with available push boats. The next step is to connect the modules 590 by engaging the cam locks on all (male) connectors 100. Camshafts 150 can then be rotated to the maximum possible by, for example, two personnel utilizing a modified ICS connector ratchet.

According to this embodiment of the method of the present invention, after allowing the structure to settle into its environment, about five (5) minutes from when the last cam lock is engaged, the camshafts 150 can again be rotated to the maximum possible by, for example, two personnel utilizing a modified ICS connector ratchet. Afterwards, the modules can be restored to their desired operating configuration.

A successful connection can occur by this method, for example, when there is relative trim, heel, and draft difference between modules and all the camshafts are simultaneously or sequentially rotated to the full lock-up position 250 (as marked on the connector hex shaft and bearing housing) or 30 degrees (approximately 1.6 inches of circumferential distance on bearing housing) short of the full lock-up position in any combination.

In another embodiment of the method of the present invention, the preceding procedures can be reversed in disconnecting two floating super-assemblies that are attached side-to-side.

Figure 16:
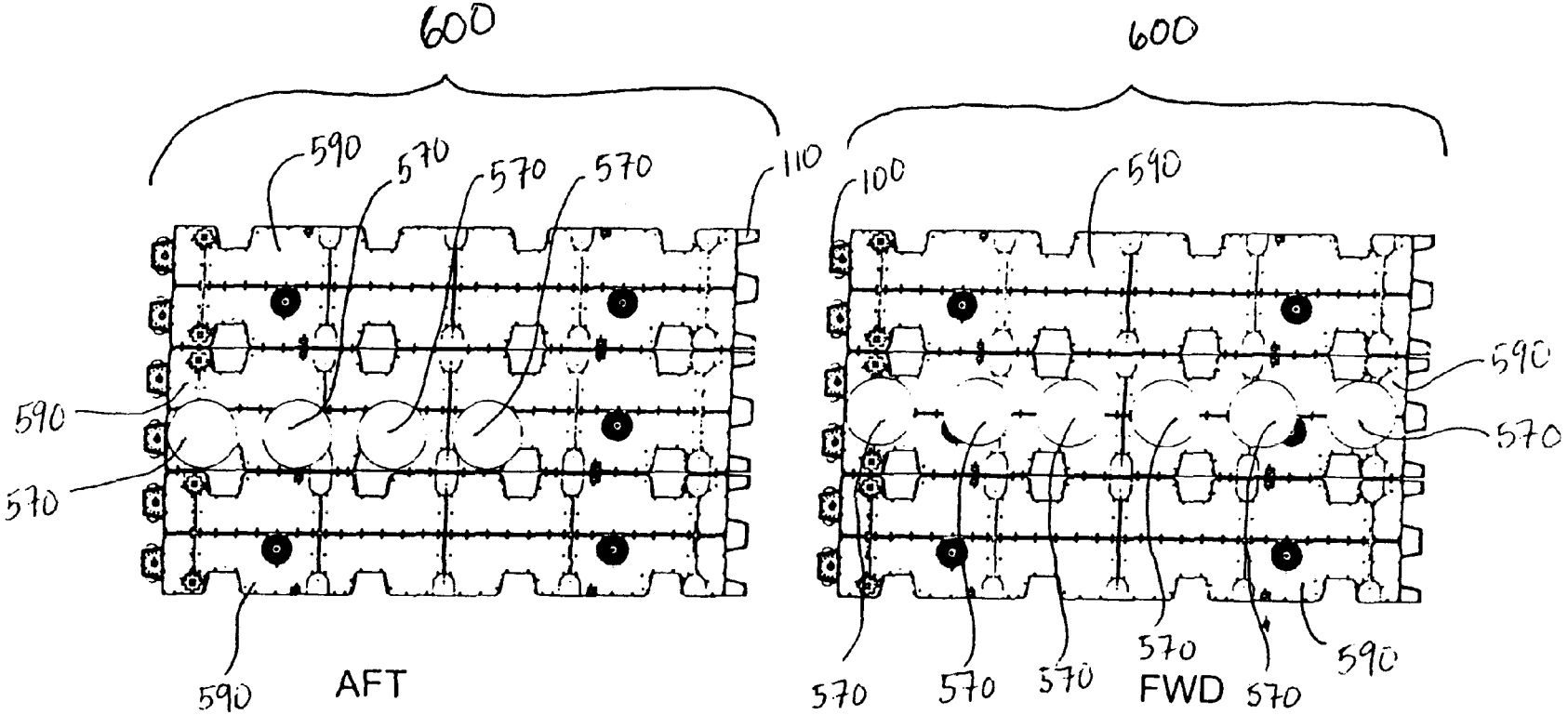
FIG. 16 is a top view of one embodiment of a ballast arrangement that simulates WT 1×3 super-assemblies.

In another embodiment of the present invention, the following procedures can be followed for connecting two floating super-assemblies end-to-end, (i.e., two 1×3 super-assemblies each consisting of three flat end modules 590 joined by male-male connectors 100, 100 and arranged per FIG. 16). Ballast tanks 570 in the quantity and location shown are placed on deck as shown in FIG. 16. These assemblies can, for example, be constructed on land and then lifted by crane into the water. Once in the water, the ballast tanks 570 are preferably filled with seawater. The 1×3 assemblies can then be joined together to form a 2×3 platform. This platform may measure, for example, approximately 80 ft.×32 ft. Sufficient water depth should preferably be present to float the assemblies (4 ft.) and allow push boats to maneuver.

The procedure of this embodiment of the method of the present invention may also begin with the two 1×3 super assemblies in the water. Next, all existing connectors 100 are ratcheted to full lock-up position if they were not at full lock-up position on land. Next, 550-gallon ballast tanks 570 can be placed on the assemblies per FIG. 16 and the tanks can be filled with seawater. Then, using push boats and bulbhook mooring lines, the male-male connectors 100, 100 of the super-assemblies 600 can be aligned with the female connector pockets 120 of the mating super-assembly 600. The modules 590 are pushed or pulled together until further movement is prevented by contact of the mating surfaces. Movement may be accomplished with lines bulbhooked into the module cloverleafs and/or with available push boats. The next step of this embodiment of the method is to connect the modules 590 by engaging the cam locks on all (male) connectors 100. Camshafts 150 are then, preferably, rotated to the maximum possible, preferably by two personnel utilizing a modified ICS connector ratchet. After allowing about five (5) minutes to elapse from when the last cam lock is engaged, the camshafts 150 can be again rotated to the maximum possible by two personnel utilizing a modified ICS connector ratchet. Afterwards, the modules can be restored to their desired operating configuration.

A successful full-strength connection occurs, for example, when there is relative trim, heel, and draft difference and all the camshafts 150 are simultaneously rotated to the full lock-up position 250 (as marked on the connector hex shaft and bearing housing) or 30 degrees (approximately 1.6 inches of circumferential distance on bearing housing) short of the full lock-up position in any combination. A successful full-strength connection may also occur when the connectors are misaligned.

In another embodiment of the present invention, the preceding procedures can be followed in reverse order to disconnect two floating super-assemblies that are attached end-to-end.

In an alternative embodiment, an ICS module contains a propulsion system.

The present invention in various embodiments provides a design for ICS that allows for quick erecting and dismantling of structures or modules. Such a design is critical in military applications and commercial applications, for instance in building a causeway as an emergency bridge (i.e., by connecting causeway pontoons). Alternatively, the connectors are adapted for structures including (but not limited to) causeway pontoons, causeway ferries, and floating discharge facilities.

Without further elaboration, it is believed that one skilled in the art, using the preceding description, can utilize the present invention to the fullest extent.

It will be apparent to those skilled in the art that various modifications and variations can be made in the connecting system, apparatus and method of the present invention and its construction without departing from the scope and spirit of the invention. Other embodiments of the invention will be apparent to those skilled in the art from consideration of the specification and practice of the invention disclosed herein. It is intended that the specification and examples be considered as exemplary only of the present invention.

I claim:

1. An interlocking system for connecting at least two floating structures comprising:

at least one male finger attached to a first structure;

at least one female finger attached to a second structure;

at least one connector body attached to said male finger;

a receiver dispose on said female finger adapted to receive and retain said connector body;

a camshaft rotatably fixed within said male finger; and at least one cam located about and attached to said camshaft in said male finger.

2. The system of claim 1, wherein said cam is connected to said connector body.

3. The system of claim 1 wherein said male finger is tapered.

4. The system of claim 1 wherein said female finger is tapered.

5. The system of claim 1 wherein said connector body is a ball.

6. The system of claim 1 wherein said receiver is a receptor plate.

7. The system of claim 6 wherein said receptor plate is adapted to restrain said connector body in three dimensions.

8. The system of claim 6 wherein said female receptor plate is adapted to support loads in three dimensions.

9. The system of claim 6 wherein said receptor plate further comprises an indentation in the shape of said connector body.

10. The system of claim 9 wherein said indentation is indented for receiving a spherical shape.

11. The system of claim 9 wherein said indentation is indented for receiving a substantially spherical shape.

12. The system of claim 1 wherein said male finger includes a means for aligning said first structure with said second structure.

13. The system of claim 1 wherein said female finger includes a means for aligning said second structure with said first structure.

14. The system of claim 1 wherein said first structure further comprises an extending means for connecting other devices to said first structure.

15. The system of claim 1 wherein said second structure further comprises an extending means for connecting other devices to said second structure.

16. The system of claim 1 wherein said male finger and said female finger are adapted to be interlocked together.

17. The system of claim 1 wherein said connector body of said male finger is insertably positioned into said receiver of said female finger to form a connection between said structures.

18. The system of claim 17 wherein said connector body and said female finger are positioned loosely together.

19. The system of claim 17 wherein said connection is adapted to lock together.

20. The system of claim 17 wherein said connection is adapted to disconnect.

21. The system of claim 1 wherein two male fingers are positioned to form a female pocket.

22. An interlocking system for connecting at least two floating structures comprising:

at least one male finger attached to a first structure;

at least one female finger attached to a second structure;

at least one connector body attached to said male finger, wherein said connector body is substantially spherical; and a receiver disposed on said female finger adapted to receive and retain said connector body.

23. The system of claim 22, wherein said connector body is spherical.

24. The system of claim 22 wherein said cam is connected to said connector body.

25. The system of claim 22 wherein said male finger is tapered.

26. The system of claim 22 wherein said receiver is a receptor plate.

27. The system of claim 26 wherein said receptor plate is selected from the group consisting of a female receptor plate and a male receptor plate.

28. The system of claim 26 wherein said receptor plate is adapted to restrain said connector body in three dimensions.

29. The system of claim 27 wherein said female receptor plate is adapted to support loads in three dimensions.

30. The system of claim 26 wherein said receptor plate further comprises an indentation in the shape of said connector body.

31. The system of claim 30 wherein said indentation is indented for receiving a spherical shape.

32. The system of claim 30 wherein said indentation is indented for receiving a substantially spherical shape.

33. The system of claim 22 wherein said male finger includes a means for aligning said first structure with said second structure.

34. The system of claim 22 wherein said female finger includes a means for aligning said second structure with said first structure.

35. The system of claim 22 wherein said first structure further comprises an extending means for connecting other devices to said first structure.

36. The system of claim 22 wherein said second structure further comprises an extending means for connecting other devices to said second structure.

37. The system of claim 22 wherein said male finger and said female finger are adapted to be interlocked together.

38. The system of claim 22 wherein said connector body of said male finger is insertably positioned into said receiver of said female finger to form a connection between said structures.

39. The system of claim 38 wherein said connector body and said female finger are positioned loosely together.

40. The system of claim 38 wherein said connection is adapted to lock together.

41. The system of claim 38 wherein said connection is adapted to disconnect.

42. The system of claim 22 wherein two male fingers are positioned to form a female pocket.

43. The system of claim 22 wherein said female finger is tapered.

44. An interlocking system for connecting at least two floating structures providing a locking mechanism comprising:

at least one male finger attached to a first structure;

at least one female finger attached to a second structure;

at least one connector body attached to said male finger;

a receiver disposed on said female finger adapted to receive and retain said connector body;

a camshaft disposed within said male finger at least one bearing rotatably connected to said camshaft;

a socket attached to said bearing;

a locking pin adapted to fit through said socket; and a tightening device adapted to connect with said socket.

45. The system of claim 44 wherein said socket is adapted to connect with said tightening device.

46. The system of claim 44 wherein said tightening device is removable.

47. The system of claim 44 wherein said mechanism for locking is covered by a safety plate.

48. The system of claim 47 wherein said safety plate is removable.

49. The system of claim 44 wherein said locking pin is adapted for a plurality of positioning settings.

50. The system of claim 44 wherein said bearing is adapted for a plurality of positioning settings.

51. An interlocking system for connecting at least two floating structures providing a locking mechanism comprising:

at least one male finger attached to a first structure;

at least one female finger attached to a second structure;

at least one connector body attached to said male finger;

a receiver disposed on said female finger adapted to receive and retain said connector body;

a camshaft disposed within said male finger;

at least one bearing rotatably connected to said camshaft;

a socket attached to said bearing;

a locking key adapted to fit within said socket; and a tightening device adapted to connect with said socket.

52. The system of claim 51 wherein said socket is adapted to connect with said tightening device.

53. The system of claim 51 wherein said tightening device is removable.

54. The system of claim 51 wherein said mechanism for locking is covered by a safety plate.

55. The system of claim 54 wherein said safety plate is removable.

56. The system of claim 51 wherein said locking key is adapted for a plurality of positioning settings.

57. The system of claim 51 wherein said bearing is adapted for a plurality of positioning settings.

58. The system of claim 51 wherein said socket is adapted to connect with said tightening device.

59. The system of claim 51 wherein said tightening device is removable.

60. The system of claim 51 wherein said socket is adapted for connection with a plurality of tightening poles.

61. The system of claim 60 wherein said tightening poles further comprise at least one grip handle.

62. An interlocking system for connecting at least two structures comprising:

at least one male finger attached to a first structure;

at least one female finger attached to a second structure;

at least one connector body attached to said male finger;

a receiver disposed on said female finger adapted to receive and retain said connector body;

a camshaft disposed within said male finger; and a mechanism for locking said interlocking system attached to said camshaft.

63. The system of claim 62 wherein said connecting body is spherical.

64. The system of claim 62 wherein said connector body is substantially spherical.

65. The system of claim 62 wherein said connector body is a ball.

66. The system of claim 64 wherein said camshaft device further comprises a shaft and at least one cam.

67. The system of claim 62 wherein said cam is connected to said connecting body.

68. The system of claim 62 wherein said connecting body and said receiver are adapted to be interlocked together.

69. The system o f claim 62 wherein said receiver is a receptor plate.

70. The system of claim 69 wherein said receptor plate and said connecting body form a connection.

71. The system of claim 69 wherein said connection is adapted to lock together.

72. The system of claim 69 wherein said connection is adapted to disconnect.

73. The system of claim 66 wherein said shaft is a propeller shaft.

74. The system of claim 62 wherein said locking mechanism comprises one or more bearings.

75. The system of claim 62 wherein said locking mechanism comprises a locking pin.

76. The system of claim 62 wherein said locking mechanism comprises a locking key.

77. The system of claim 74 wherein said bearings are adapted to interlock with said locking key.

78. The system of claim 62 wherein said receptor plate is adapted to restrain said connector body in three dimensions.

79. The system of claim 69 wherein said receptor plate is an indentation of said connector body.

80. The system of claim 79 wherein said indentation is indented for receiving a spherical shape.

81. The system of claim 79 wherein said indentation is indented for receiving a substantially spherical shape.

82. The system of claim 79 wherein said receptor plate is adapted to support loads in three dimensions.

83. The system of claim 62 wherein said male finger is tapered.

84. The system of claim 62 wherein said female finger is tapered.

85. A method for connecting at least two floating structures in relative motion between said structures comprising the steps of:

insertably positioning a male finger into a female finger rotating a camshaft in said male finger; and reliably locking said camshaft.

86. The method of claim 85 wherein said positioning step comprises positioning said fingers in a loose alignment.

87. The method of claim 85 wherein said camshaft forces connector bodies into said female finger.

88. The method of claim 85 wherein said relative motion includes six degrees of freedom.

89. A method for achieving a full strength connection between two misaligned floating structures in relative motion between said structures comprising the steps of:

insertably positioning a male finger into a female finger rotating a camshaft in said male finger; and reliably locking said camshaft.

90. The method of claim 89 wherein said connection eliminates said relative motion.

91. The method of claim 89 wherein said relative motions include six degrees of freedom.

92. The method of claim 89 wherein said positioning step comprises positioning said fingers in a loose alignment.

93. The method of claim 89 further comprising inserting or moving a connector body into said female finger.

94. The method of claim 89 wherein said connection eliminates said misalignment.

95. A method for connecting at least two floating structures in relative motion between said structures said step for connecting including:

operating a camshaft;

establishing a connection between at least two tapered fingers; and inserting a connector body into a receiver.

96. The method of claim 95 wherein said relative motions include six degrees of freedom.

* * * * *